US007388169B2

(12) United States Patent
Azzola et al.

(10) Patent No.: US 7,388,169 B2
(45) Date of Patent: Jun. 17, 2008

(54) ELECTRICAL DEVICE WITH FIXED CONTACTS, MOBILE CONTACTS AND INSPECTABLE ARC CHAMBERS

(75) Inventors: Lucio Azzola, Bergamo (IT); Stefano Besana, Terno d'Isola (IT)

(73) Assignee: ABB Service S.r.l. (IT)

( * ) Notice: Subject to any disclaimer, the term of this patent is extended or adjusted under 35 U.S.C. 154(b) by 0 days.

(21) Appl. No.: 11/320,753

(22) Filed: Dec. 30, 2005

(65) Prior Publication Data

US 2006/0148288 A1 Jul. 6, 2006

(30) Foreign Application Priority Data

Dec. 30, 2004 (IT) ..... BG2004A0048

(51) Int. Cl.
*H01H 33/02* (2006.01)

(52) U.S. Cl. ..... 218/155; 200/293

(58) Field of Classification Search ..... 218/152–157, 218/14, 15, 34, 147–149; 200/293, 17 R; 335/8–10, 202, 201
See application file for complete search history.

(56) References Cited

U.S. PATENT DOCUMENTS

| | | | | |
|---|---|---|---|---|
| 4,970,482 | A * | 11/1990 | Jacobs et al. | 335/201 |
| 5,298,874 | A * | 3/1994 | Morel et al. | 335/8 |
| 5,479,143 | A * | 12/1995 | Payet-Burin | 335/202 |
| 6,064,018 | A * | 5/2000 | Seymour et al. | 200/293 |
| 6,373,357 | B1 * | 4/2002 | Douville et al. | 335/172 |
| 6,542,057 | B2 * | 4/2003 | Douville et al. | 335/172 |

* cited by examiner

*Primary Examiner*—K. Richard Lee
*Assistant Examiner*—Marina Fishman
(74) *Attorney, Agent, or Firm*—Connolly Bove Lodge & Hutz LLP; Myron Keith Wyche

(57) ABSTRACT

An electrical device for low-voltage applications that comprises at least one fixed contact designed to connect to a corresponding mobile contact; the electrical device also comprises at least one module, on which said fixed contact is housed, and the module is operatively connected to a structural part of the device and is at least partially separable from said structural part.

15 Claims, 8 Drawing Sheets

ELECTRICAL DEVICE WITH FIXED CONTACTS, MOBILE CONTACTS AND INSPECTABLE ARC CHAMBERS

FIELD OF THE INVENTION

The present invention relates to a low-voltage electrical device provided with fixed contacts, mobile contacts and arc chambers that can be inspected.

BACKGROUND OF THE INVENTION

Low-voltage electrical devices, such as for example switches circuit-breakers and disconnectors, are, as is known, devices used generally in electrical systems the operating voltage of which generally reaches up to 1000 V. It is likewise known that for correct functioning of such devices it is necessary to envisage and carry out periodic interventions of inspection and maintenance.

The interventions of inspection envisage checking of the state and functionality of the components in order to choose the type of intervention of maintenance to carry out. The maintenance interventions can be divided principally into ones of a conservative type and ones of a replacement type. In interventions of a conservative type, operations are carried out that substantially involve adjustment, calibration and setting, cleaning and regeneration of one or more components constituting the device in order to restore them to optimal operating conditions. In interventions of a replacement type, instead, replacement is made of one or more components that, following upon operation of the device, have undergone alterations such as to jeopardize their functionality irreversibly.

The configuration of current electrical devices is far from conducive to either of the types of maintenance just referred to. The components making up the devices are in fact connected to one another according to a well-defined sequence of assembly. This aspect entails that the possible regeneration and/or replacement of one of the components assembled at the start of the sequence imposes as a consequence dismantling and subsequent re-assembly of a large number of the components.

Low-voltage circuit-breakers, for example, comprise, as is known, one or more seats in which one or more fixed contacts are housed that are to be connected to corresponding mobile contacts in the proximity of an arc chamber. An appropriate kinematic chain enables movement of the mobile contacts.

Traditionally, the fixed contacts are inserted and positioned within the respective seats before the mobile contacts and before the components of the kinematic chain. It is therefore understandable how, in the current state of the art, possible operations of maintenance carried out on the fixed contacts, for example of a replacement nature, impose the need to dismantle numerous functional parts of the devices such as, for example, mobile contacts, kinematic chains and arc chambers.

Some solutions present on the market are conducive to operations of inspection, i.e. checking of the conditions of the circuit-breakers. In some cases, for example, removable grills are used, located on the outer surface of the devices in the proximity of the arc chamber or arc chambers. Removal of these grills enables, in the best of cases, removal of the arc chambers, but does not facilitate or in any case is not effectively conducive to possible maintenance interventions. In particular, there remain prevented interventions of a replacement type on the fixed contacts. The very operations of inspection and conservative maintenance can be carried out only in a partial and approximate way, on account of the limited space and angle of access to the fixed and/or mobile contacts.

There is therefore the need to have available electrical devices for low-voltage applications, that will enable to overcome the previously cited drawbacks.

SUMMARY OF THE INVENTION

Thus the main aim of the present invention is to provide an electrical device the structure of which will facilitate the operations of inspection of the fixed contacts, mobile contacts and corresponding arc chambers.

Another purpose of the present invention is to provide an electrical device the structure of which will facilitate the operations of maintenance of the fixed contacts, mobile contacts and corresponding arc chambers.

Not the least important purpose of what forms the subject of the present invention is to provide an electrical device that will present a high degree of reliability and will be relatively easy to produce at competitive costs.

The above tasks, as well as the above and other related purposes that will appear more clearly from what follows, are achieved by an electrical device for low-voltage applications that comprises at least one fixed contact designed to connect to a corresponding mobile contact; the electrical device according to the invention comprises at least one module, on which said fixed contact is housed, said module being operatively connected to a structural part of the device and being at least partially separable from said structural part.

One of the main advantages of the invention lies in the possibility of removing the fixed contacts from their normal operative position in order to enable inspection and maintenance thereof, as well as possible similar interventions on the mobile contacts or on the arc chambers. The presence of a removable module on which the fixed contacts are housed does not entail dismantling of other components constituting the electrical device, unlike the case of solutions currently available on the market.

Further characteristics and advantages of the invention will emerge more clearly from the description of preferred, but non-exclusive, embodiments of the electrical device according to the invention, illustrated by way of non-limiting example in the annexed drawings.

DESCRIPTION OF PREFERRED EMBODIMENTS

In the following description reference is made in particular to an electrical device 1 used as a triple-pole single-break circuit-breaker (see FIGS. 1 to 6). The technical solutions and the considerations that will be presented may in any case extend also to other electrical devices (see, for example, FIGS. 7 to 9) which are normally used in the context of low-voltage systems and comprise fixed contacts.

With reference to the attached figures, the electrical device 1 according to the invention comprises at least one fixed contact designed to connect to a corresponding mobile contact in the proximity of an area of breaking, according to modalities and embodiments well known in the art and hence not illustrated in detail.

The electrical device 1 according to the invention comprises a module 30 on which the fixed contact is housed. The module 30 is operatively connected to a structural part 5 of the device 1 in such a way that the corresponding fixed contact assumes an operative position in which it connects up to the respective mobile contact. The module 30 has a shaped body, at least in part made of an insulating material comprising one or more seats, in each of which a fixed contact is mounted. The module 30 is moreover at least partially separable from the structural part 5 of the device 1 in order to enable the operations of inspection and maintenance of the fixed contact and/or of the corresponding mobile contact to be carried out.

On the basis of what has been said so far, the module 30 thus assumes a first position in which it is stably connected to the structural part 5 of the device 1 and a second position in which it is totally or partially separated from the same structural part 5. This second position enables a user to carry out conveniently the operations of maintenance on the fixed contacts or on the module itself. In this second position the module 30 is prearranged, for example, for the subsequent possible dismantling of the fixed contacts or else for replacement or regeneration of the parts of the module itself in order to restore optimal conditions of electrical insulation following upon, for example, natural degradation due to the presence of sublimated material.

Figure 1:
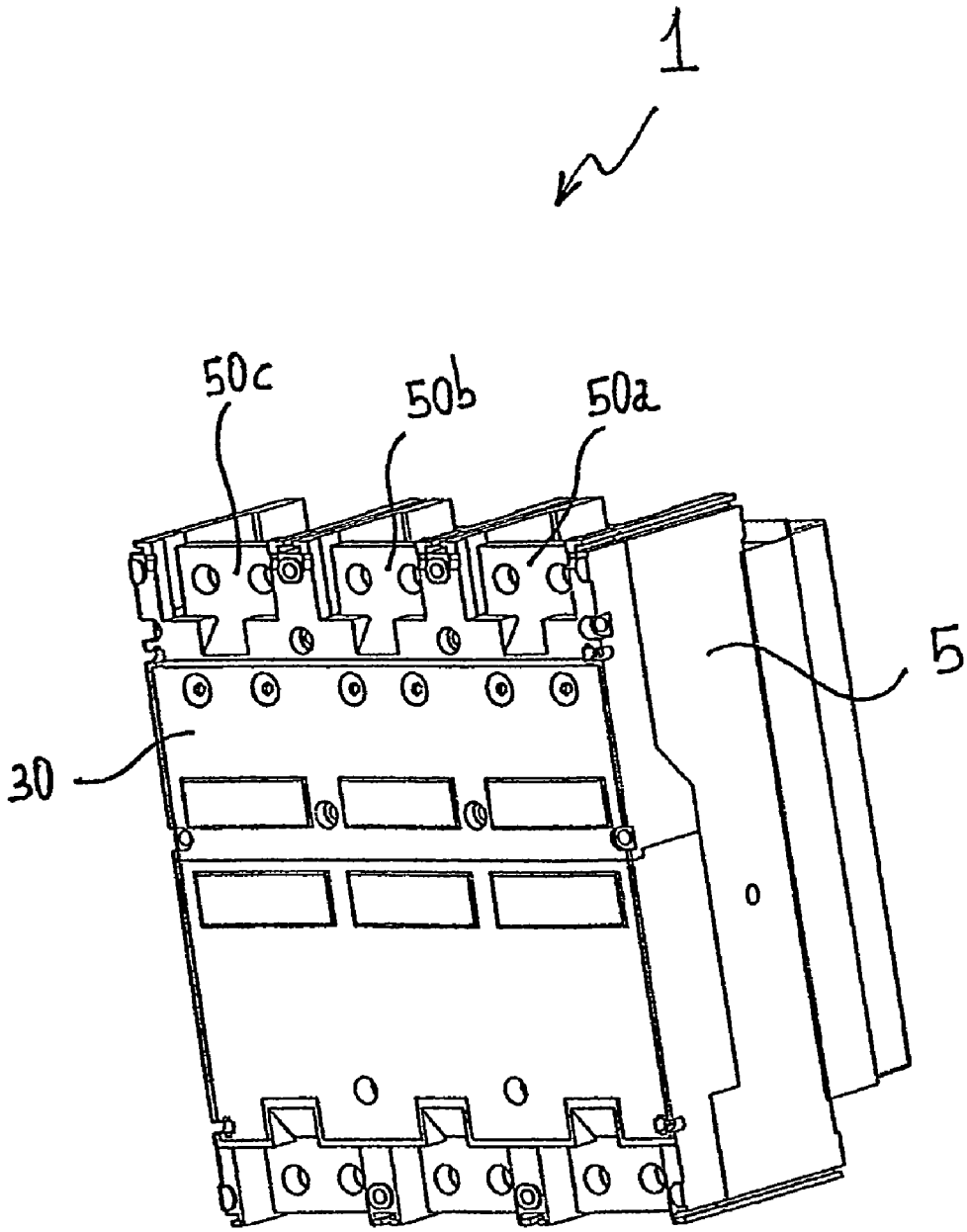
FIG. 1 is a perspective view of a first possible embodiment of an electrical device according to the invention, specifically a triple-pole single-break circuit-breaker.
Figure 2:
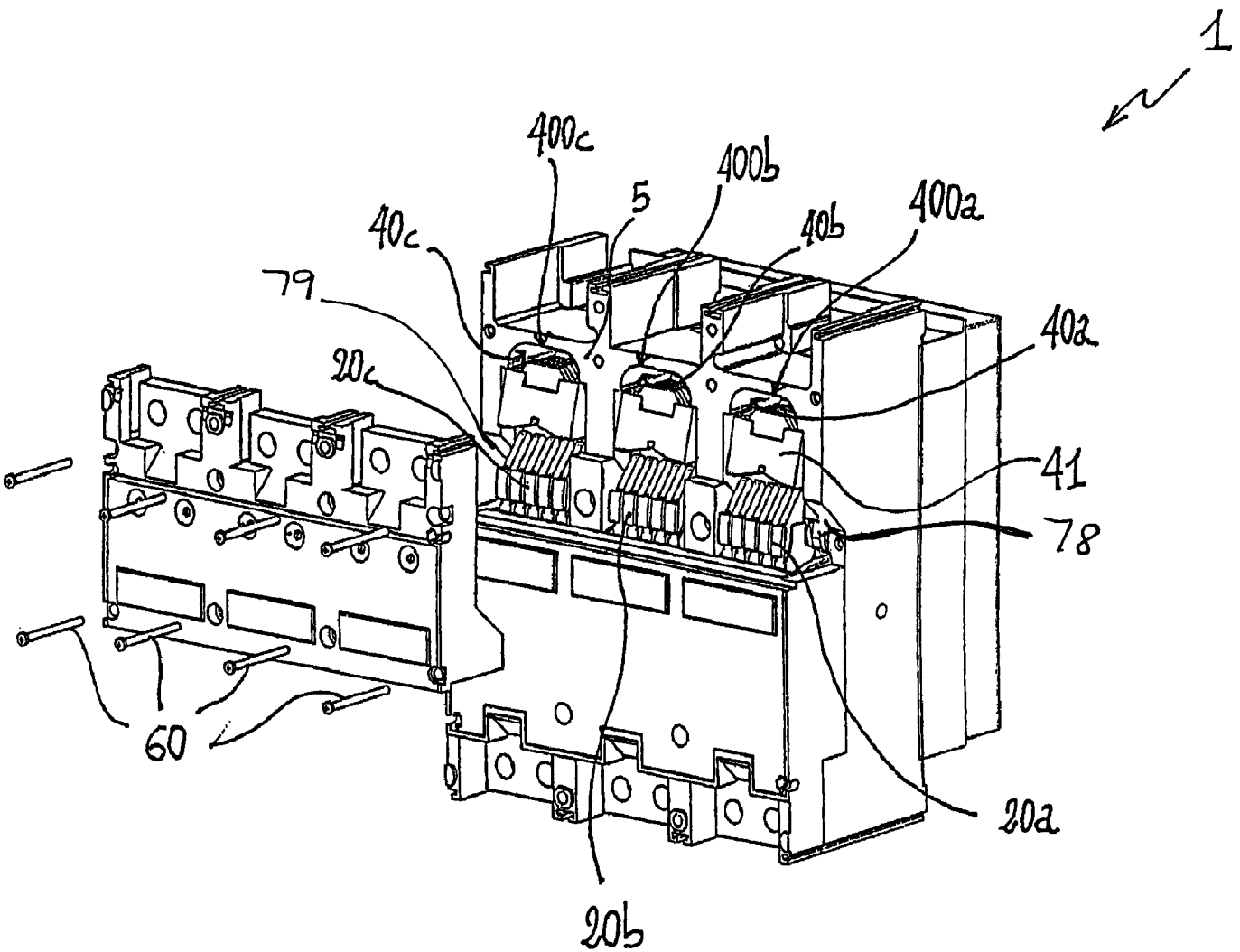
FIG. 2 is an exploded view of the electrical device appearing in FIG. 1.

FIGS. 1 and 2 are, respectively, a first, perspective, view and a second, exploded, view corresponding to a first embodiment of the electrical device 1 according to the invention. The device 1 comprises a plurality of arc chambers 400*a*, 400*b*, 400*c*, in each of which at least one mobile contact 20*a*, 20*b*, 20*c* is connected to at least one fixed contact 10*a*, 10*b*, 10*c* (see FIG. 3). In particular, the module 30 is connected to said structural part 5 so as to position itself in an area corresponding to said arc chambers 400*a*, 400*b*, 400*c*.

According to a preferred embodiment of the invention, at least one, but preferably each, of the arc chambers 400*a*, 400*b*, 400*c* is constituted by a cavity 40*a*, 40*b*, 40*c* and comprises a plurality of arc-breaker elements 41, which are, for example, connected to one another and are designed to favour extinction of the electric arc that is formed during separation of the contacts.

As is evident from FIG. 2, once the partially separable module 30 is connected to the structural part 5, it constitutes a wall delimiting the cavities 40*a*, 40*c*, 40*c*, and its possible removal basically opens an advantageous "window" that enables the user to carry out inspection and/or maintenance of each arc chamber 40 and of the possible arc-breaker elements 41 present therein. In particular, the latter can to advantage be extracted from the corresponding cavities 40*a*, 40*b*, 40*c* and subsequently re-inserted at the end of the operations of inspection and/or maintenance.

Once again with reference to FIG. 2, during normal operation of the device 1, the separable module 30 is operatively connected to the structural part 5 through connection means such as, for example, tightening screws or bolts. Said connection means have the function of contrasting the thrust deriving from the impact of the mobile contacts 20*a*, 20*b*, 20*c* on the respective fixed contacts 10*a*, 10*b*, 10*c* following upon closing of the contacts.

In the solution in FIG. 2, the connection means are constituted by tightening screws 60 located at a height of the separable module 30 in the proximity of which the cited thrust of impact is generated. Of course, the solution just described constitutes only one example of the innumerable forms of connection and sealing that can be used for the same purpose.

Figure 4:
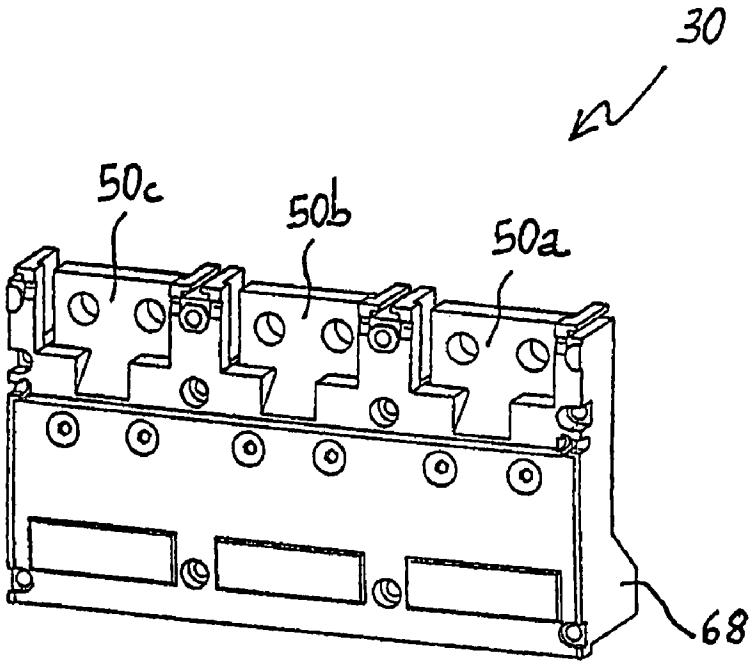
FIGS. 3 and 4 are, respectively, a first perspective view and a second perspective view of a possible embodiment of an at least partially separable module according to the invention.
Figure 3:
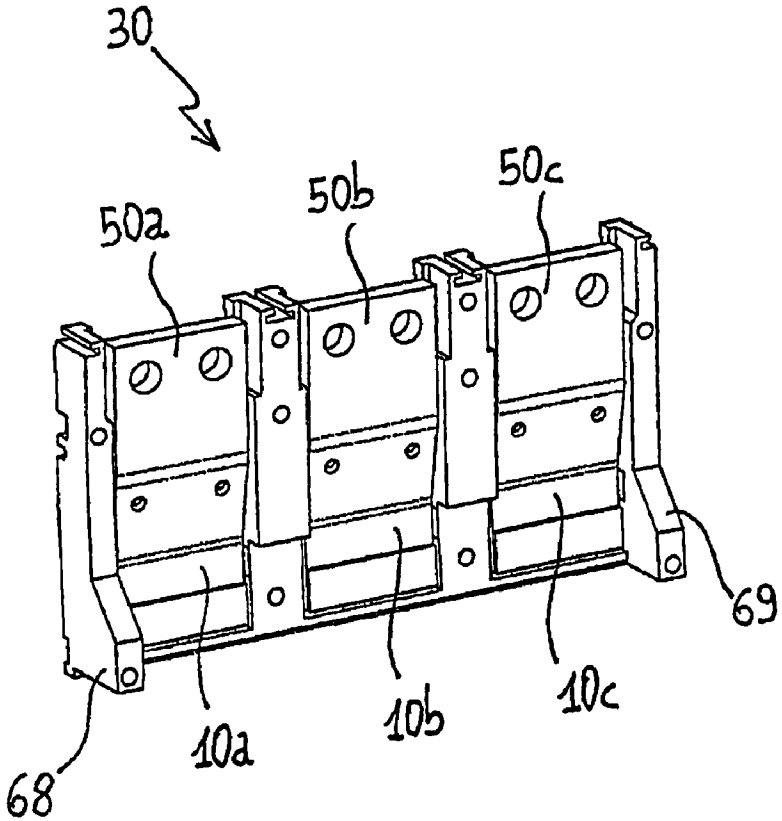

FIGS. 3 and 4 illustrate an embodiment of the at least partially separable module 30. In particular the module comprises also one or more electrodes 50*a*, 50*b*, 50*c*, each of which is operatively connected to one of said fixed contacts 10*a*, 10*b*, 10*c*. The module 30 illustrated is moreover preferably made of insulating material; alternatively, at least the surface of the module 30 up against the fixed contacts must present insulating characteristics.

From the structural standpoint, the module 30 comprises a first ribbing 68 and a second ribbing 69 designed to combine with a first recess 78 and a second recess 79 made in the structural part 5 of the device 1. The cited ribbings 68 and 69 and recesses 78 and 79 have as their main function that of favouring the union of the module 30 to the structural part 5 through their substantially complementary shape, which to advantage guides the connection of the parts. The joinable parts so far indicated can in any case be variously shaped and made indifferently on the module 30 and on the structural wall 5 according to a principle of complementarity.

With reference once again to FIG. 2, the solution illustrated envisages that the module 30 is removed completely from the structural part 5 so as to be separated therefrom. Of course, this is to be considered exclusively as a possible embodiment in so far as falling within the inventive idea are possible alternative solutions in which the module 30 remains partially constrained to the structural part 5, for example, via the use of hinges, assuming basically a function similar to that of a door.

In the solutions so far illustrated, the module 30 substantially takes the form of a single body shaped in such a way as to house a plurality of fixed contacts.

Figure 5:
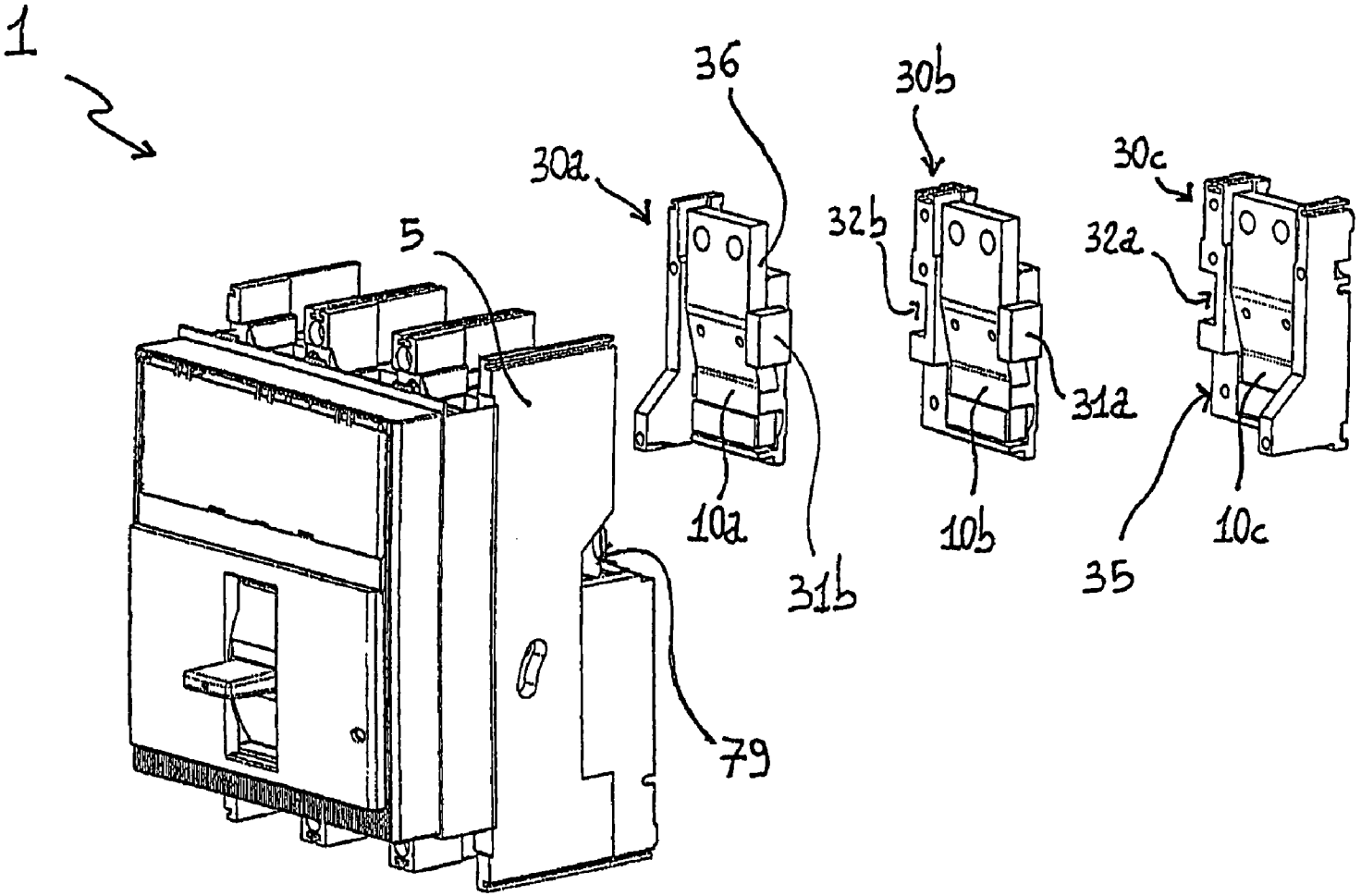
FIG. 5 is an exploded view of a second embodiment of an electrical device according to the invention, specifically a triple-pole single-break circuit-breaker.
Figure 6:
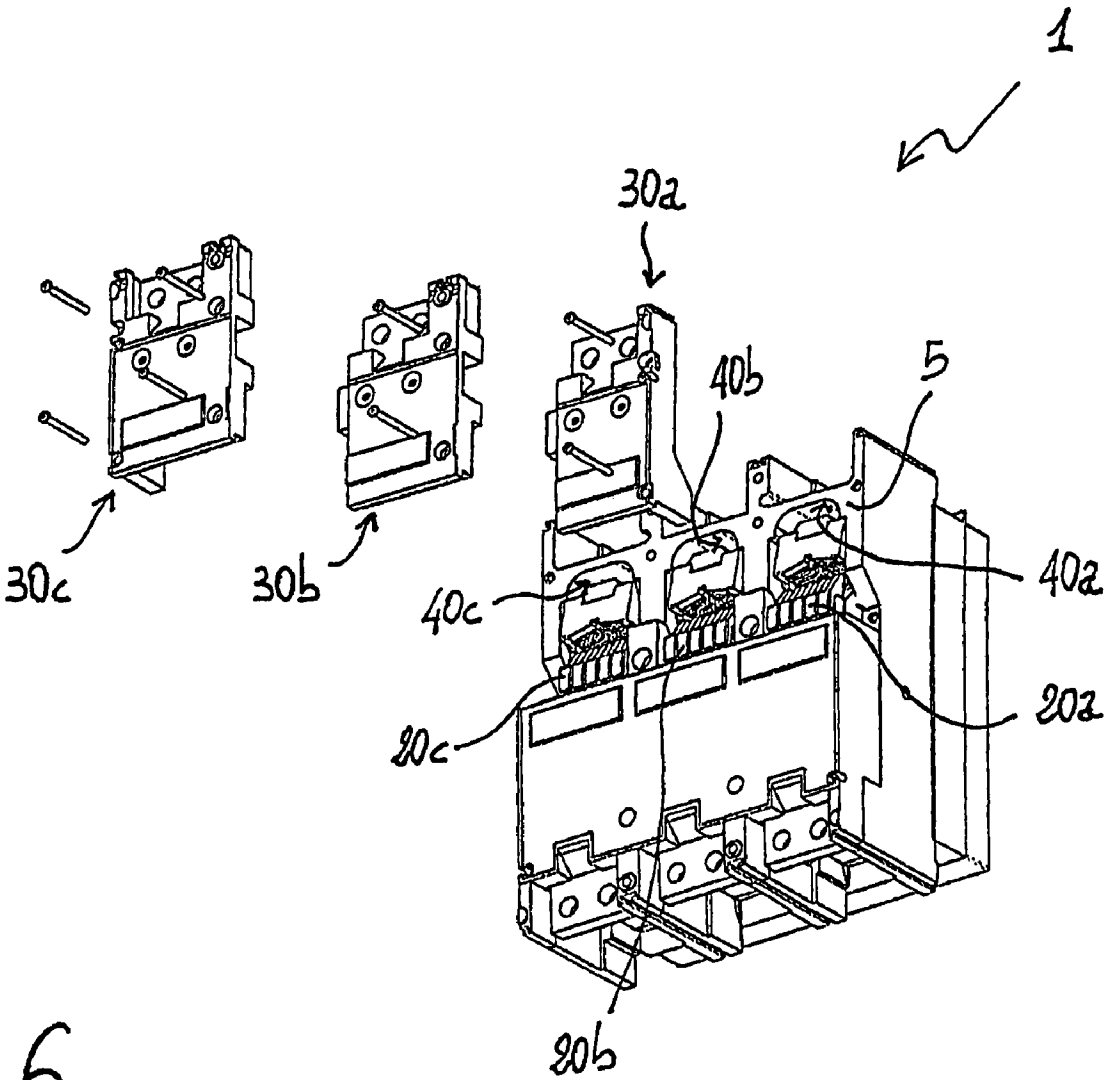
FIG. 6 is a second exploded view of the electrical device appearing in FIG. 5.

FIGS. 5 and 6 regard a second embodiment of the invention, in which the use of a plurality of at least partially separable modules 30*a*, 30*b*, 30*c* is envisaged, each of which designed to house at least one of the fixed contacts 10*a*, 10*b*, 10*c* of the electrical device 1. Each of these modules 30*a*, 30*b*, 30*c* is individually connected to the structural part 5 of the device 1 in an area corresponding to an arc chamber, as may be noted clearly from FIG. 6. Basically, associated to each partially separable module are corresponding connection means, for example, like the ones already referred to above. This technical solution enables a user to inspect, and possibly intervene on, a single fixed contact, a single arc chamber or else a single module.

In the embodiment illustrated in FIGS. 5 and 6, the device 1 comprises, in particular, at least one first partially separable module 30*a*, which is mutually constrained to a second module 30*b* adjacent thereto. In particular, the first module 30*a* comprises, along a first side 35 thereof, a recess 32*a* designed to house a key 31*a* emerging from a second side 36 of the second partially separable module 30*b*. The latter comprises moreover a second recess 32*b* designed to receive a second key 31*b* emerging from a third partially separable module 30*c* adjacent to said second module 30*b*. Basically, in the solution illustrated, each of said partially separable modules is not only connected to the structural part 5 but also constrained to at least one of the modules adjacent thereto. This latter technical solution enables an increase in the structural rigidity of the connection, distributing the mechanical stresses in a more uniform way.

As already mentioned above, the circuit-breaker illustrated in the figures so far referred to is of the single-break type, but it remains understood that the present invention can conveniently be applied also to single-pole or multipole double-break devices of the translating-mobile contact type or else rotating-mobile contact type. In this connection, FIG. 7 regards a double-break disconnector 2 having translating mobile contacts. In addition to a first set of fixed contacts, as in the previous solutions, the disconnector 2 comprises also a second set of contacts that are located in positions symmetrical to the first with respect to a transverse axis of the disconnector. The disconnector 2 comprises a pair of at least partially separable modules such that a first module 30*d* comprises the first set of fixed contacts, whilst a second module 30*e* houses the second set of fixed contacts.

Of course, falling within the scope of the inventive idea is the possibility of making a single removable module comprising both of the sets of contacts, as well as the possibility of making a number of modules each comprising one or more fixed contacts.

Figure 7:
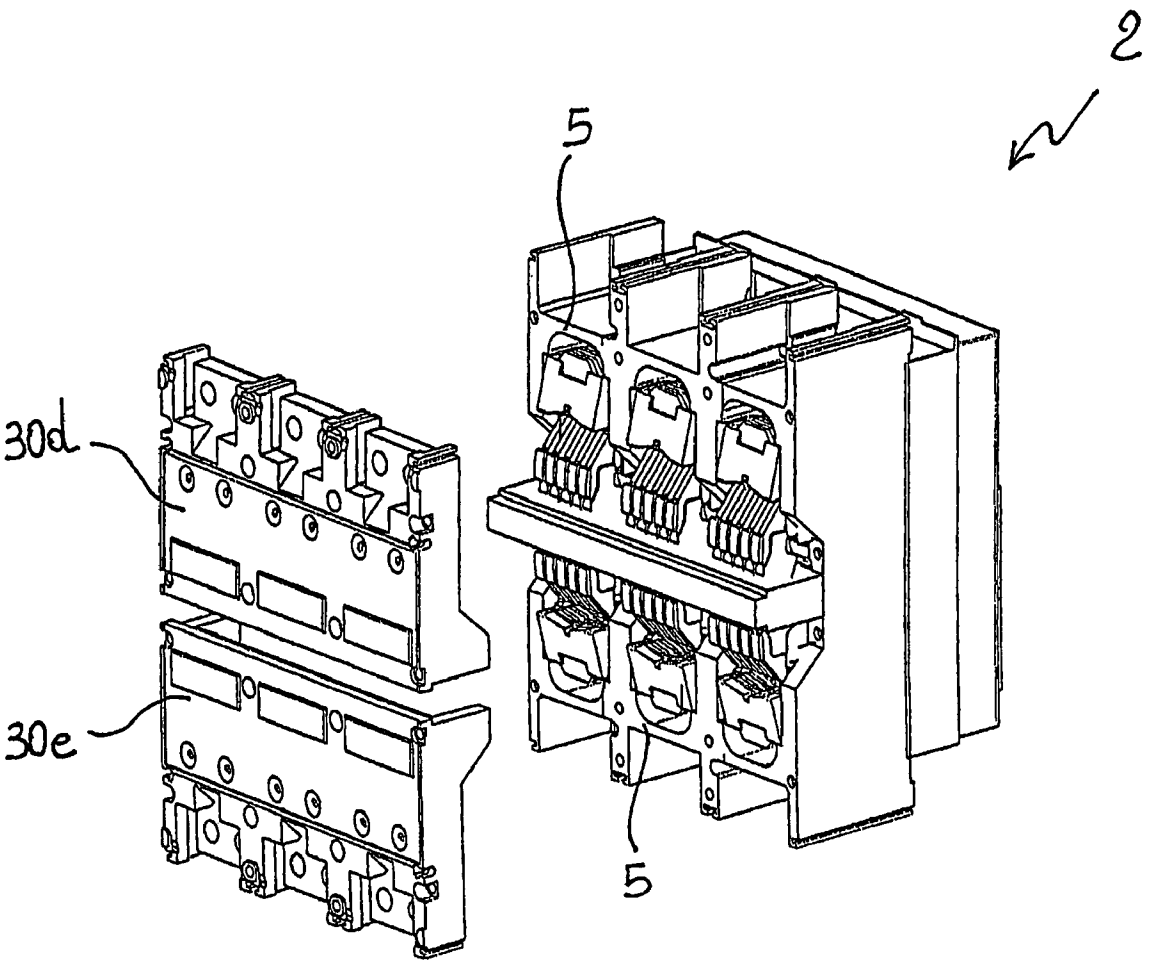
FIG. 7 is a perspective view of a third embodiment of a second electrical device according to the invention, specifically a triple-pole double-break disconnector.
Figure 8:
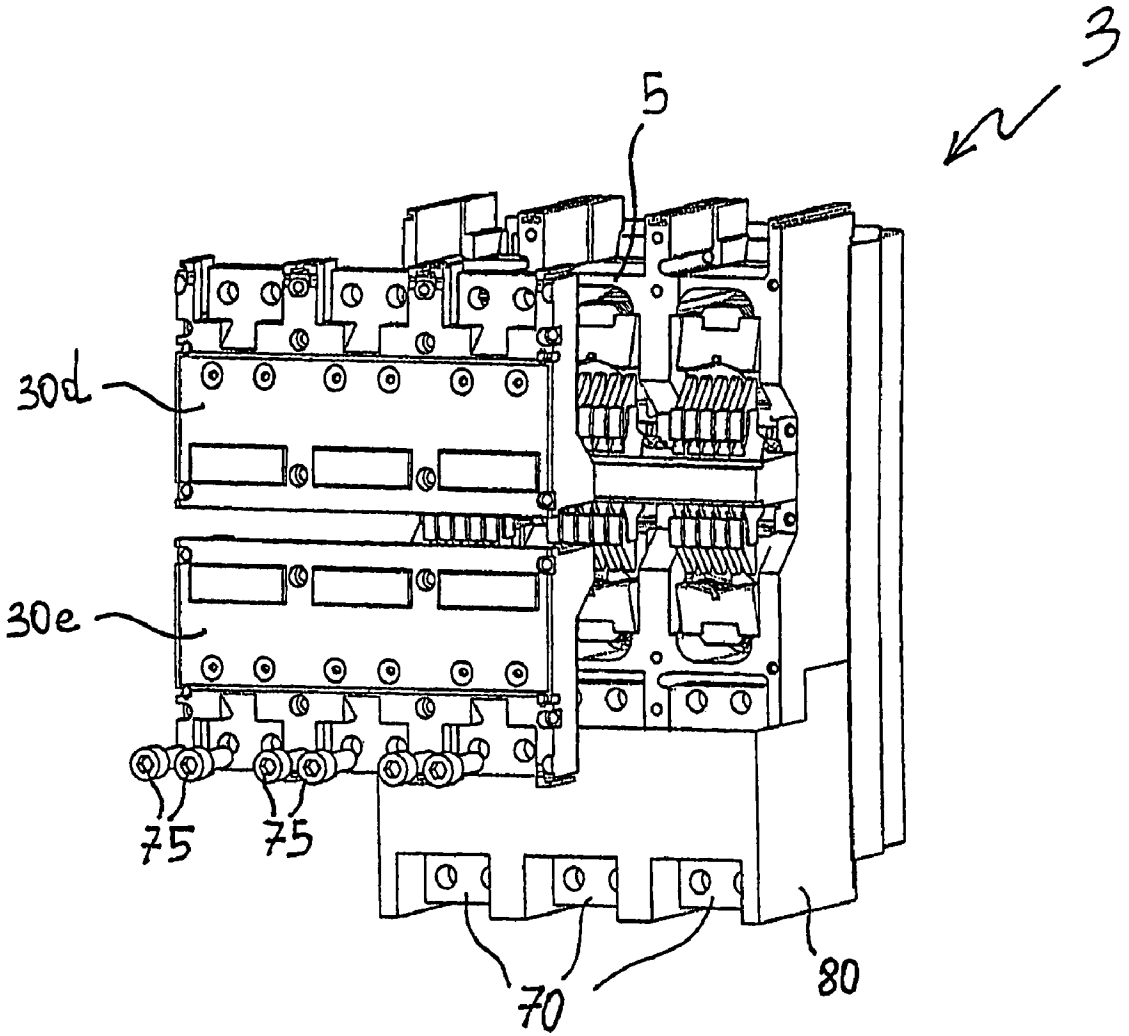
FIG. 8 is a perspective view of a fourth embodiment of the electrical device according to the invention, specifically a triple-pole double-break circuit-breaker with translating mobile contacts.

FIG. 8 regards, instead, a triple-pole double-break circuit-breaker 3 with translating mobile contacts and is distinguishable from the solution illustrated in FIG. 7 on account of the presence of a bottom containment module 80 designed to house, for example, current sensors and/or protection relays. The circuit-breaker 3 in question also comprises a set of connection elements 70, only the ends of which are visible in FIG. 8. Of said ends, the top ones connect to the fixed contacts, for example via the illustrated bolts 75, whilst the bottom ones constitute the bottom electrodes of the circuit-breaker.

Figure 9:
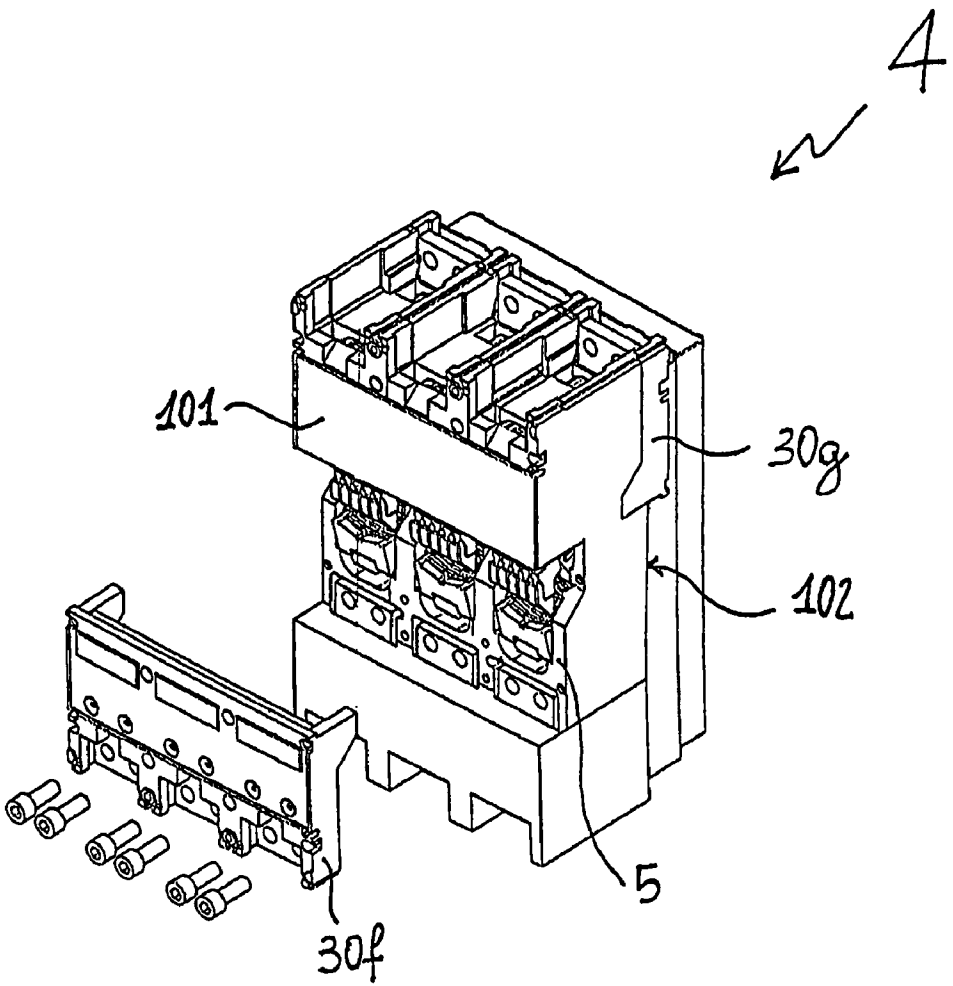
FIG. 9 is a perspective view of a fifth embodiment of the electrical device according to the invention, specifically a triple-pole double-break circuit-breaker with rotating mobile contacts.

FIG. 9 regards a double-break circuit-breaker with rotating mobile contacts 4. In this solution, there may be noted the presence of a rear module 30*f* (illustrated in exploded view) and of a front module 30*g*, which are connected to the structural part 5 of the device 4 in an area corresponding, respectively, to a rear surface 101 and a front surface 102. In particular, in the solution illustrated, the rear module 30*f* is connected to the structural part 5 at a lower height with respect to the front module 30*g*.

The technical solutions adopted for the electrical device fully meet the intended purposes. In particular, through the use of one or more at least partially separable modules, the operations of inspection and maintenance of the fixed contacts and/or of the arc chambers are considerably simplified to the advantage of a reduction in the overall times and costs.

The invention claimed is:

1. An electrical device for low-voltage applications comprising:

at least one fixed contact designed to connect to one or more corresponding mobile contacts;

at least one module, on which said fixed contacts are housed;

at least one structural part comprising a cavity constituting an arc chamber having at least a mobile contact located therein;

wherein said at least one module assumes a first position in which it is stably connected to said structural part, said fixed contact assuming an operative position, in which said fixed contact connects up to said mobile contact, when said at least one module is in said first position, said at least one module constituting one of the walls delimiting said cavity when said module is in said first position;

wherein said module assumes a second position, in which it is at least partially separated from said structural part;

wherein the passage of said at least one module from said first position to said second position determines at least the partial removal of said fixed contact from moveable contact and the opening of a window for inspection and/or maintenance in said arc-chamber.

2. The electrical device according to claim 1, wherein, said at least one module constituting one of multiple walls delimiting said cavity and wherein said plurality of arc-chamber elements are extractable from corresponding cavities during the at least one of inspection and maintenance and subsequently re-insertable.

3. The electrical device according to claim 1, wherein said at least one module is completely separable from said at least one structural part and is operatively connected thereto through connection means.

4. The electrical device according to claim 2, wherein said at least one module is completely separable from said at least one structural part and is operatively connected thereto through connection means.

5. The electrical device according to claim 3, wherein said connection means comprise tightening screws, said tightening screws being located at a height of said at least one module at which said at least one mobile contact is connected to said at least one fixed contacts.

6. The electrical device according to claim 1, wherein said at least one module comprises a first ribbing and a second ribbing configured to combine with a first recess and a second recess made in said at least one structural part.

7. The electrical device according to claim 3, wherein said at least one module comprises a first ribbing and a second ribbing configured to combine with a first recess and a second recess made in said at least one structural part.

8. The electrical device according to claim 1, wherein said at least one module comprises at least one electrode operatively connected to said at least one fixed contact.

9. The electrical device according to claim 3, wherein said at least one module comprises at least one electrode operatively connected to said at least one fixed contact.

10. The electrical device according to claim 1, wherein said at least one module comprises a plurality of at least partially separable modules, wherein each one of said plurality of at least partially separable modules houses one or more fixed contacts of said at least one fixed contact.

11. The electrical device according to claim 10, wherein at least a first module of said plurality of at least partially separable modules is operatively connected to said at least one structural part and is mutually constrained to at least a second module of said plurality of at least partially separable modules, said second module being adjacent to said first module.

12. The electrical device according to claim 11, wherein said first module comprises a first recess designed to receive a first key of said second module, which comprises a second recess designed to house a second key of a third module of said plurality of at least partially separable modules, wherein said third module is adjacent to said second module.

13. The electrical device according to claim 4, wherein said connection means comprise tightening screws, said tightening screws being located at a height of said at least one module at which said at least one mobile contact is connected to said at least one fixed contacts.

14. The electrical device according to claim 4, wherein said at least one module comprises a first ribbing and a second ribbing designed to combine with a first recess and a second recess made in said at least one structural part.

15. The electrical device according to claim 4, wherein said at least one module comprises at least one electrode operatively connected to fixed contact.

* * * * *